US005820498A

United States Patent [19]

Maleski

[11] Patent Number: 5,820,498

[45] Date of Patent: Oct. 13, 1998

[54] BROADHEAD FOR AN ARROW HAVING EXPANDING CUTTING BLADES AND METHOD OF ASSEMBLING SAME

[75] Inventor: Richard C. Maleski, Plymouth, Conn.

[73] Assignee: WASP Archery Products, Inc., Plymouth, Conn.

[21] Appl. No.: 697,286

[22] Filed: Aug. 26, 1996

[51] Int. Cl.[6] ..... F42B 6/08

[52] U.S. Cl. ..... 473/584

[58] Field of Search ..... 273/421, 422; D22/115; 473/582–585

[56] References Cited

U.S. PATENT DOCUMENTS

| | | | |
|---|---|---|---|
| D. 232,731 | 9/1974 | Altier . | |
| D. 279,813 | 7/1985 | Palizzolo . | |
| D. 342,303 | 12/1993 | Johnson | D22/115 |
| 1,222,142 | 4/1917 | Rossi . | |
| 1,318,858 | 10/1919 | Frick . | |
| 2,289,284 | 7/1942 | Chandler . | |
| 2,568,417 | 9/1951 | Steinbacher . | |
| 2,820,634 | 1/1958 | Vance . | |
| 2,859,970 | 11/1958 | Doonan . | |
| 2,939,708 | 6/1960 | Scheib . | |
| 2,993,697 | 7/1961 | Urban . | |
| 3,036,396 | 5/1962 | Swails . | |
| 3,138,383 | 6/1964 | McKinzie . | |
| 3,241,836 | 3/1966 | Zwickie . | |
| 3,578,328 | 5/1971 | Rickie . | |
| 3,586,332 | 6/1971 | Alban . | |
| 3,600,835 | 8/1971 | Hendricks . | |
| 3,759,519 | 9/1973 | Palma . | |
| 4,099,720 | 7/1978 | Zeren | 273/422 |
| 4,166,619 | 9/1979 | Bergmann et al. . | |
| 4,175,749 | 11/1979 | Simo | 273/422 |
| 4,210,330 | 7/1980 | Kosbab . | |
| 4,381,866 | 5/1983 | Simo . | |
| 4,452,460 | 6/1984 | Adams | 273/422 |
| 4,558,868 | 12/1985 | Musacchia | 273/422 |
| 4,579,348 | 4/1986 | Jones . | |
| 4,615,529 | 10/1986 | Vocal . | |
| 4,621,817 | 11/1986 | Musacchia . | |
| 4,807,382 | 2/1989 | Albrecht . | |
| 4,905,397 | 3/1990 | Juelg, Jr. . | |
| 4,932,671 | 6/1990 | Anderson, Jr. | 273/421 |
| 4,940,246 | 7/1990 | Stagg . | |
| 4,976,443 | 12/1990 | DeLucia . | |
| 4,998,738 | 3/1991 | Puckett . | |
| 5,046,744 | 9/1991 | Eddy | 273/421 |
| 5,066,021 | 11/1991 | DeLucia . | |
| 5,078,407 | 1/1992 | Carlston et al. . | |
| 5,082,292 | 1/1992 | Puckett et al. . | |
| 5,083,798 | 1/1992 | Massay . | |
| 5,090,709 | 2/1992 | Johnson | 273/422 |
| 5,100,143 | 3/1992 | Puckett . | |
| 5,102,147 | 4/1992 | Szeluga | 273/422 |
| 5,112,063 | 5/1992 | Puckett . | |
| 5,178,398 | 1/1993 | Eddy | 273/421 |
| 5,314,196 | 5/1994 | Ruelle . | |
| 5,322,297 | 6/1994 | Smith . | |
| 5,354,068 | 10/1994 | Maleski | 273/422 |
| 5,417,440 | 5/1995 | Barrie et al. . | |
| 5,458,341 | 10/1995 | Forrest et al. | 273/421 |
| 5,472,213 | 12/1995 | Dudley . | |
| 5,478,089 | 12/1995 | Austin . | |
| 5,482,293 | 1/1996 | Lekavich . | |

*Primary Examiner*—Paul E. Shapiro
*Attorney, Agent, or Firm*—Dilworth & Barrese

[57] ABSTRACT

A broadhead for an arrow having a mechanism for securing expanding cutting blades to the body portion or ferrule of the broadhead which insures true alignment of the longitudinal axis of the broadhead with the longitudinal axis of the cutting blades. A compressible ring holds the cutting blades adjacent their proximal ends to form a ring-cutting blade assembly. The ring is placed over a post member extending from the body portion. A washer may be provided for positioning between the ferrule and a cylindrical insert located at the distal end of the arrow shaft. Inserting the post member into the arrow shaft and insert forces the washer to move distally and apply pressure to the ring-cutting blade assembly. The pressure applied to the ring-cutting blade assembly compresses and wedges the ring within a circular gap formed at the point where the post member extends from the body portion to firmly secure the blades to the broadhead. An elastic ring may be provided around the cutting blades to maintain the cutting blades in an undeployed, retracted position. The retracted blade assembly may also be fixedly secured to enable the user to utilize the broadhead as a target point.

18 Claims, 4 Drawing Sheets

Fig. 5
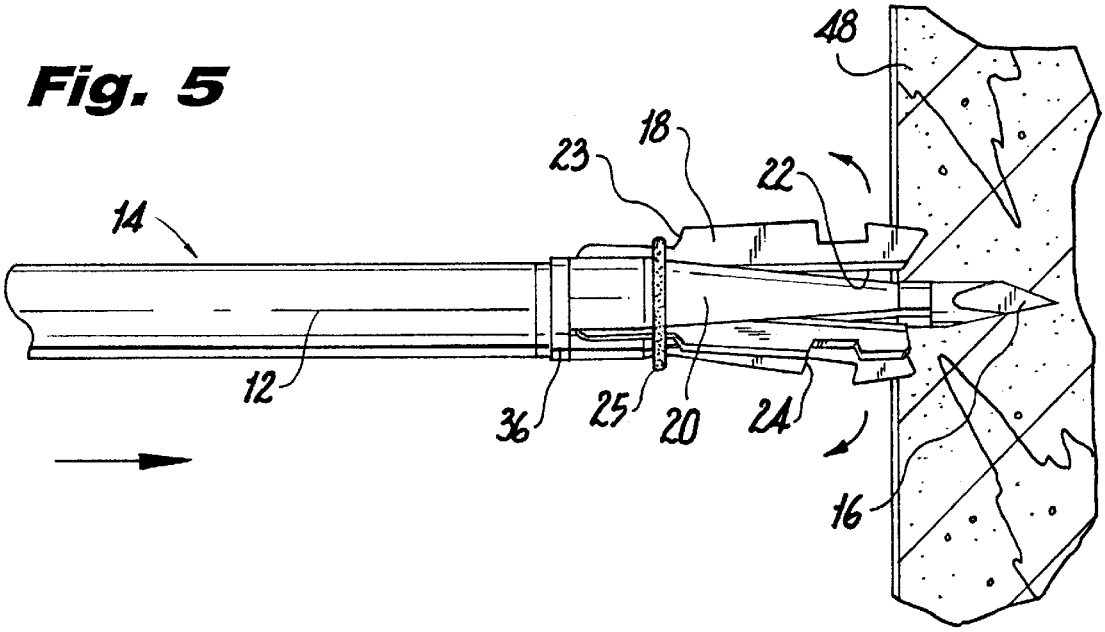
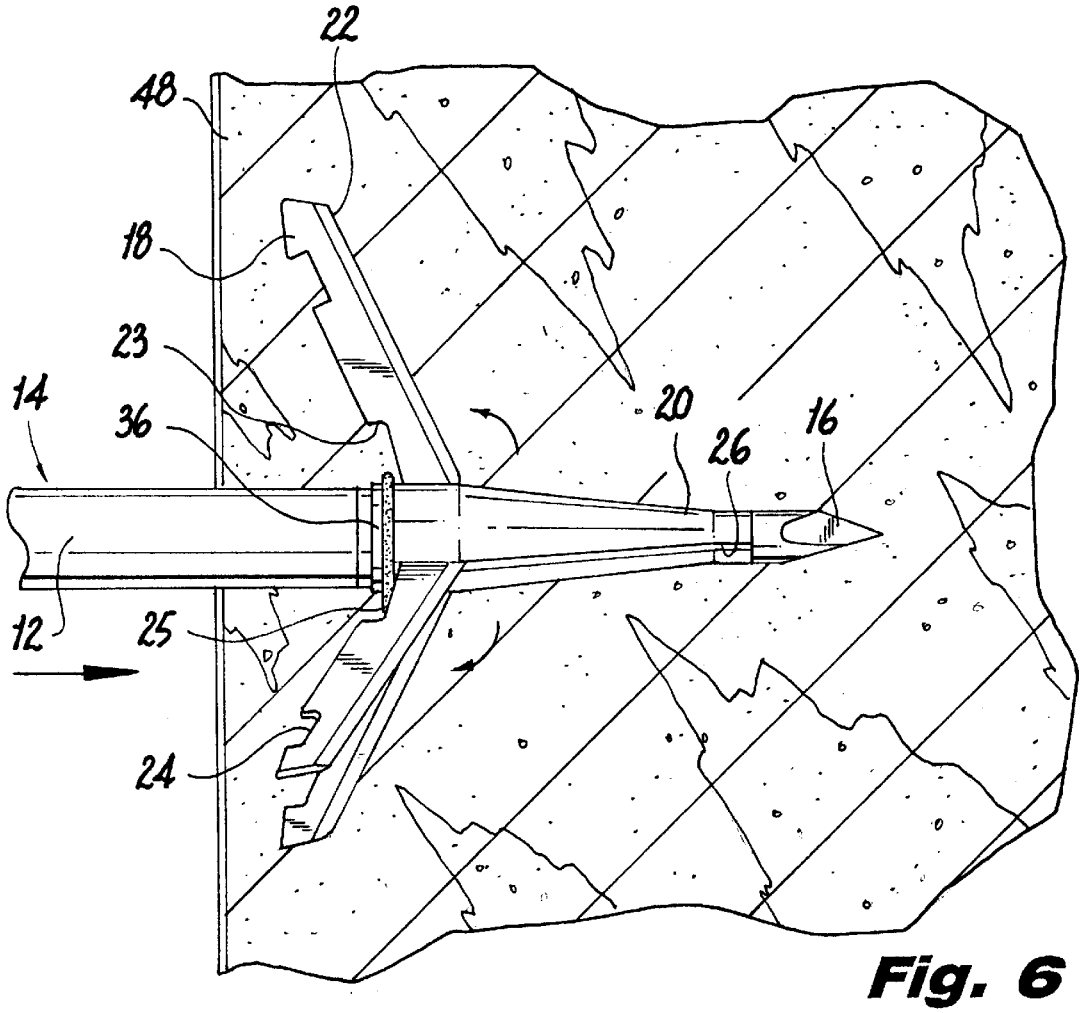
Fig. 6

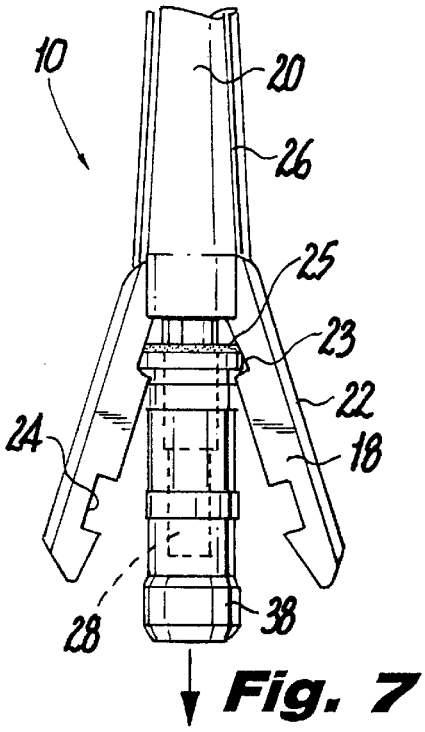
Fig. 7
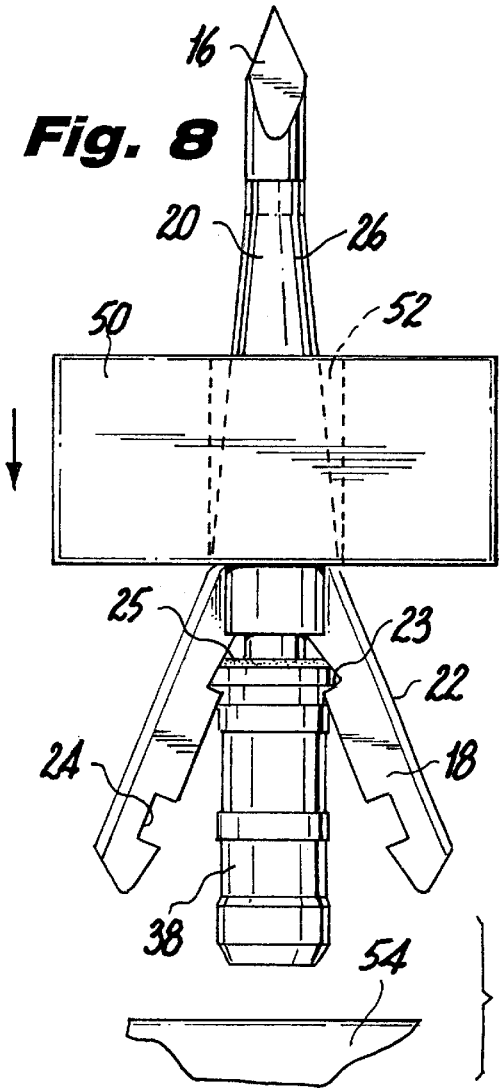
Fig. 8
Fig. 9
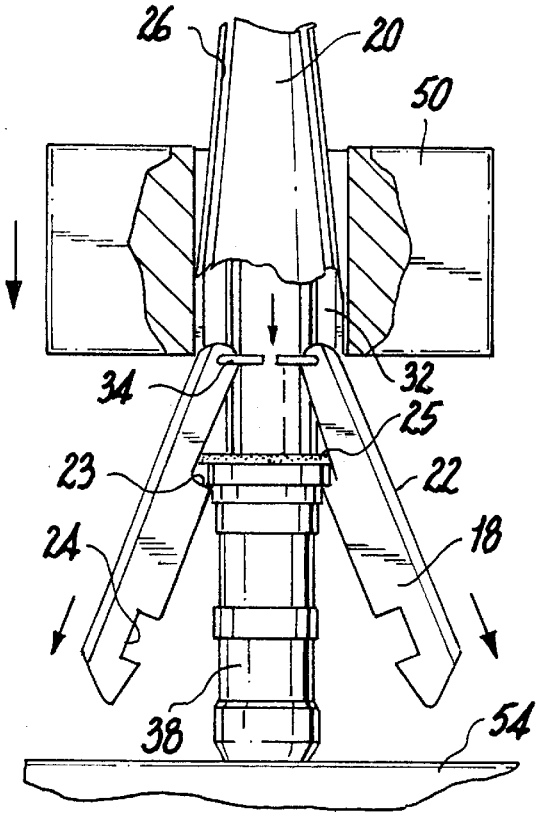
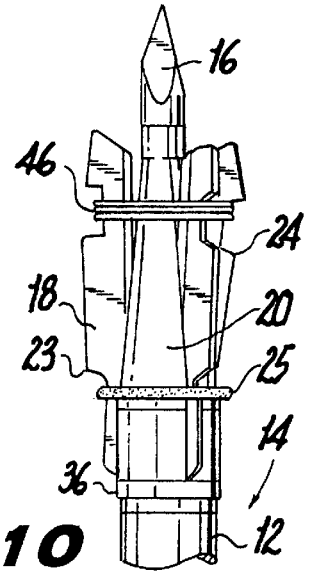
Fig. 10

BROADHEAD FOR AN ARROW HAVING EXPANDING CUTTING BLADES AND METHOD OF ASSEMBLING SAME

BACKGROUND OF THE INVENTION

1. Field of the Invention

The present invention generally relates to a broadhead for an arrow having expanding cutting blades and a method of securing and removing the cutting blades from the broadhead. More particularly, the present invention is directed to a broadhead having cutting blades which are held in an undeployed retracted position and moved to a deployed expanded position when the arrow strikes a target and to a method for securing the cutting blades configured as a single replaceable unit to the broadhead. The present invention is also directed to a broadhead having expanding cutting blades which may be held in an undeployed position so that the broadhead may be utilized as a target point if desired.

2. Description of the Prior Art

Broadheads having cutting blades which are held in an undeployed retracted position and moved to a deployed expanded position when the arrow strikes a target are well known in the art. Broadheads designed with deployable cutting blades overcome the problems associated with wind drag and other adverse wind effects during the flight of the arrow. For example, U.S. Pat. No. 5,112,063 to Puckett discloses a broadhead having deployable cutting blades which are kept in a retracted position during the flight of an arrow by a tubular external restraint which fits over the ferrule of the broadhead. When the broadhead impacts against a target, such as an animal, a deployment mechanism causes the blades to be deployed, cutting the tubular restraint from the ferrule.

Various means for securing the expanding cutting blades to the ferrule of the broadhead have been developed in an effort to provide an aerodynamically balanced arrow with the capability of instantaneously deploying the cutting blades upon the arrow striking the target. Pivotable connecting pins are typically utilized for securing expanding cutting blades to the broadhead as disclosed in, for instance, U.S. Pat. No. 3,600,835 to Hendricks, U.S. Pat. No. 4,099,720 to Zeren, and U.S. Pat. No. 5,090,709 to Johnson, among others.

Many other prior art broadheads provide pivotably connecting pins linking the expanding cutting blades to a plunger mechanism which causes the blades to deploy once the arrow strikes the target. These are disclosed in, for instance, U.S. Pat. No. 5,102,147 to Szeluga, and U.S. Pat. No. 5,112,063 to Puckett, among others.

Prior means for securement of expanding cutting blades to the broadhead, such as those discussed above, are subject to several disadvantages which primarily affect the performance of the arrow during use. In particular, the use of pivotably connecting pins and plunger mechanisms subjects the broadhead to added weight which generally affects the trajectory of the arrow. Additionally, the use of connecting pins and plunger mechanisms for facilitating deployment of the cutting blades increases the cost, slows the assembly process and generally renders the blades non-replaceable. Furthermore, if the pins or the parts comprising the plunger mechanism are not properly aligned, the balance of the arrow may be thrown off which will affect its accuracy during flight. In addition, it is difficult for a user to change the cutting blades of the prior art broadheads when they become chipped, broken or blunt, since the pins are typically factory-set and require special tools for removal.

The novel means for securing the expanding cutting blades to the broadhead of the present invention obviates the disadvantages encountered in the prior art and provides an efficient means for securing the blades to the broadhead which maintains the balance and aerodynamic performance of the arrow. The means for securing the expanding cutting blades to the broadhead also provides for a more efficient assembling process during manufacture and use, and facilitates the replaceability of the blades in the field. The present invention also allows for the expanding cutting blades to he held in an undeployed position so that the broadhead may be utilized as a target point.

SUMMARY OF THE INVENTION

The present invention provides a broadhead having a securement mechanism for securing expanding cutting blades configured as a single replaceable unit to the broadhead and a method of assembling the blades and securement mechanism to the broadhead. The securement mechanism of the present invention maintains the balance and aerodynamic properties of an arrow without adding appreciable additional weight. Further, the securement mechanism of the present invention reduces the time and complexity of the assembling process and provides an efficient method for securing the cutting blades during manufacture and use.

Further still, the securement mechanism for securing the cutting blades to the broadhead obviates the requirement for exact tolerances present in the assembly of prior art broadheads while providing a precise alignment of the cutting blades with the longitudinal axis of the broadhead. The aligned and balanced arrow resulting from the securement mechanism of the present invention maintains the aerodynamic properties of the arrow and insures accuracy in flight.

The broadhead and mechanism for securing the expanding cutting blades to the broadhead of the present invention may be used with any arrow, harpoon, spear or similar device.

The broadhead of the present invention comprises a pointed tip at a distal end and a ferrule having a post member extending from a proximal end, or the side opposite the pointed tip. The ferrule further includes a circular wall at the proximal end which is an extension of the outer surface of the ferrule. The diameter of the post member is smaller than the outer diameter of the ferrule, and serves to form a circular gap between the circular wall and the post member.

The securement mechanism, for securing expanding cutting blades having a cutting edge to the broadhead, comprises a ring which may be passed through a hole in each cutting blade to hold the cutting blades as a single replaceable unit, a washer, and a cylindrical insert having an internal portion. The insert may also contain means for connecting the broadhead to an arrow, as disclosed in U.S. Pat. No. 5,354,068, the contents of which are incorporated herein by reference.

In order to secure the cutting blades to the broadhead, the ring and the cutting blades form a single replaceable unit and are inserted over the post member. The cutting blades are aligned with, and partially inserted, and held within slots which extend along the ferrule. The washer is then inserted over the post member and the broadhead, blade and washer assembly is fit onto the cylindrical insert which is in position on an end of the arrow shaft.

The insert and arrow shaft are rotated so that the threaded portion of the post member engages the internal threads of the insert. As the cylindrical insert and arrow are further rotated the distal end of the insert contacts and moves the washer distally. The washer in turn pushes the ring and blades distally causing the ring to compress and become wedged in the circular gap. Further rotation of the insert and arrow shaft, until the insert is fully threaded onto the post member, secures the ring-cutting blade assembly to the broadhead. The assembling process of the ring-cutting blade assembly may also be accomplished without the washer, utilizing just the distal end of the cylindrical insert to move the ring into the circular gap.

A retaining means, such as an elastic o-ring, can be secured around the cutting blades and fit into a notch on each cutting blade for maintaining the cutting blades in an undeployed retracted position. The retaining means is disengaged from the notches when the broadhead strikes a target due to the force exerted by the target on the portion of the cutting blades partially extending from the slots. As a result, the cutting blades move into a deployed expanded position causing the area of impact on the target to be enlarged.

A second retaining means, such as a wire or string, can be secured around the cutting blades and fit into a second notch on each cutting blade for holding the cutting blades in an undeployed position so that the broadhead may be utilized as a target point if desired.

The novel securement means of the present invention allows for all the cutting blades to be replaced at the same time, since all the cutting blades are held together by the ring as a single replaceable unit. To remove the cutting blades when they become broken or blunt, the user simply removes the broadhead from the insert and arrow shaft and removes the washer if provided. The user then inverts the broadhead and pushes the distal ends of the cutting blades which are partially extending from the slots against a surface, preferably one having a cylindrical bore to accept the pointed tip of the broadhead, causing the ring to become unwedged from within the circular gap. The ring and the cutting blades are then removed from the post member and another set of cutting blades and their associated ring are placed over the post member. The washer is then placed over the post member, followed by threading the post member into the cylindrical insert on the arrow shaft, for securing the ring and the new set of cutting blades to the broadhead.

BRIEF DESCRIPTION OF THE DRAWINGS

The foregoing features of the present invention will become more readily apparent and may be understood by referring to the following detailed description of an illustrative embodiment of the broadhead of the present invention and its novel means for securing the expanding cutting blades to the ferrule portion of the broadhead, taken in conjunction with the accompanying drawings, in which:

FIGS. 5 and 6 illustrate the movement of the cutting blades from an undeployed retracted position to a deployed expanded position as the arrow strikes a target;

FIGS. 7–9 illustrate a method for removing the cutting blades from the broadhead of the present invention; and FIG. 10 illustrates a side view of the broadhead in the undeployed position with the blades secured for use of the broadhead as a target point.

DETAILED DESCRIPTION OF THE PREFERRED EMBODIMENTS

Figure 1:
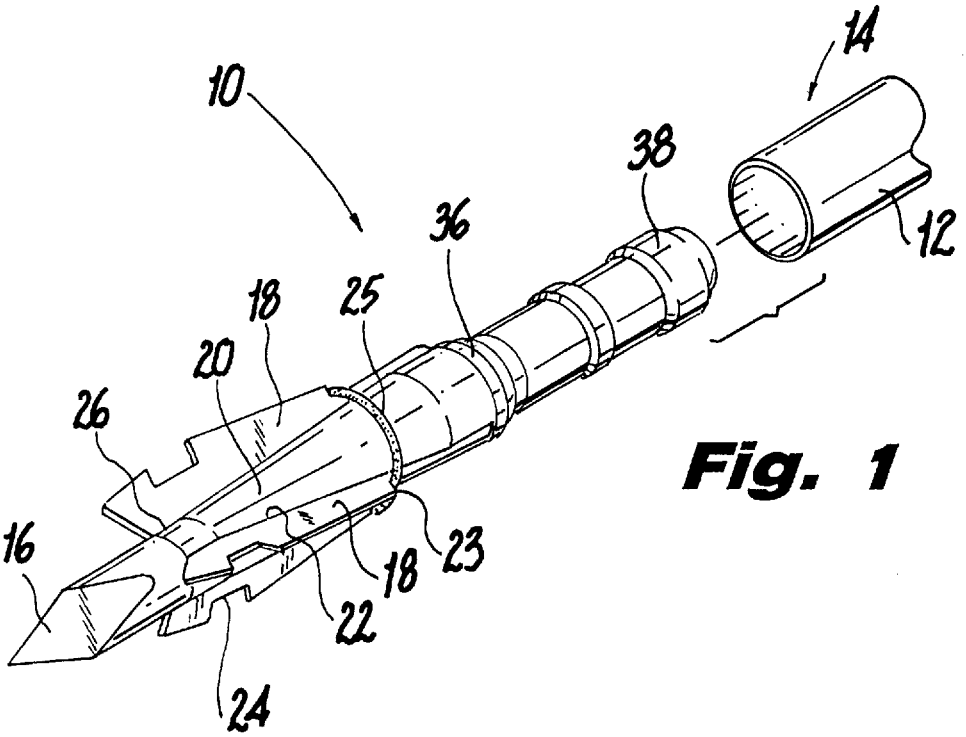
FIG. 1 illustrates a perspective, partially exploded view of an arrow having the broadhead of the present invention secured to an insert for assembly to the arrow shaft, with the cutting blades in the undeployed retracted position.

Referring now in specific detail to the drawings, in which like reference numerals identify similar or identical elements throughout the several views, FIG. 1 shows the broadhead 10 of the present invention secured to a shaft 12 of an arrow 14. Broadhead 10 includes a pointed tip 16 and cutting blades 18 attached to ferrule or a body portion 20. The cutting blades 18 include a cutting edge 22 and a notch 23 on a side opposite the cutting edge 22. The blades are secured to the broadhead 10 by a securement mechanism and maintained in an undeployed retracted position by an elastic ring 25 which engages the notch 23 of each cutting blade 18. A second notch 24 is included on each cutting blade 18 for utilizing the broadhead 10 as a target point as further discussed below.

Figure 2:
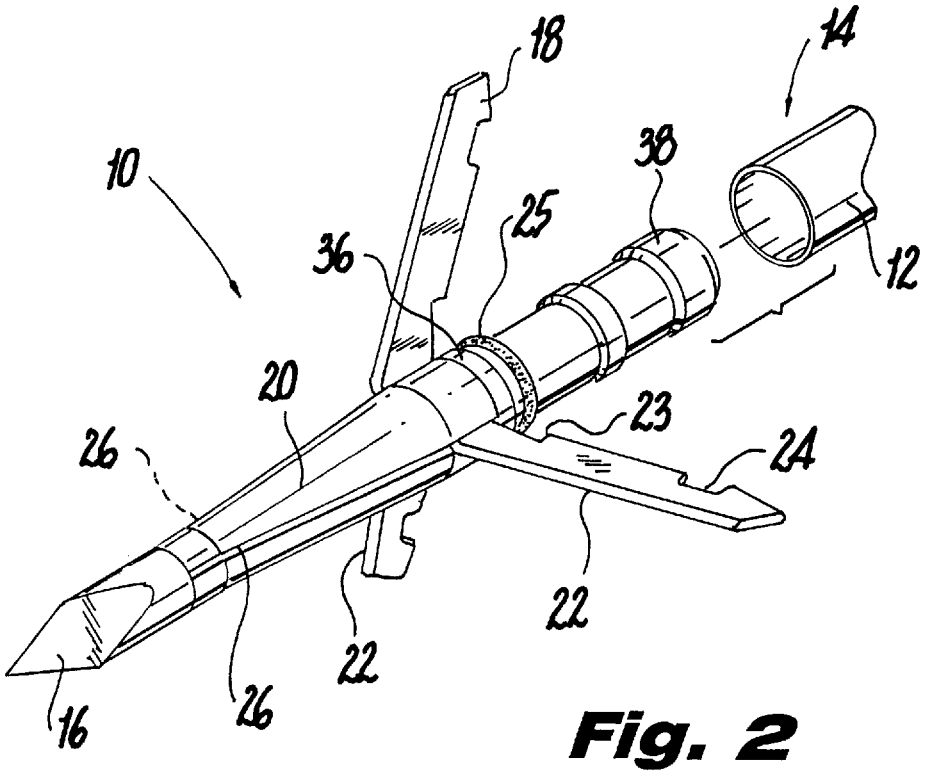
FIG. 2 illustrates a perspective, partially exploded view of the arrow of FIG. 1 having the broadhead of the present invention with the cutting blades in the expanded position.

At best seen in FIG. 2, Slots 26 extend along a major portion of the ferrule's longitudinal axis for partially inserting the expanding cutting blades 18 while in the undeployed retracted position. The broadhead 10 may be secured to the arrow shaft 12 by cylindrical insert 38 as described below, or by a locking mechanism as disclosed in U.S. Pat. No. 5,354,068, the contents of which are incorporated herein by reference. FIG. 2 illustrates the broadhead of the present invention in which the elastic ring 25 has been moved proximally along the cutting blades 18 as the blades move in a deployed expanded position.

Figure 4:
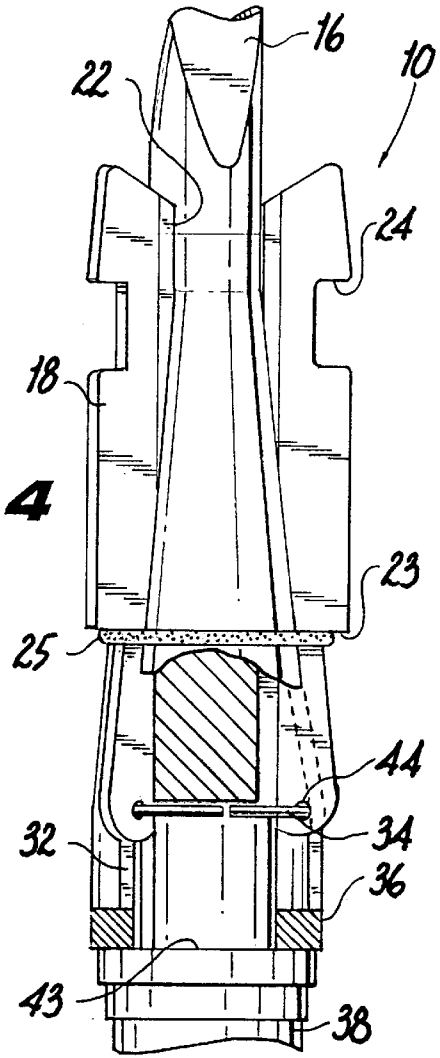
FIG. 4 illustrates a side-view in partial cross-section of the assembled broadhead and novel means for securing the cutting blades of the present invention.
Figure 3:
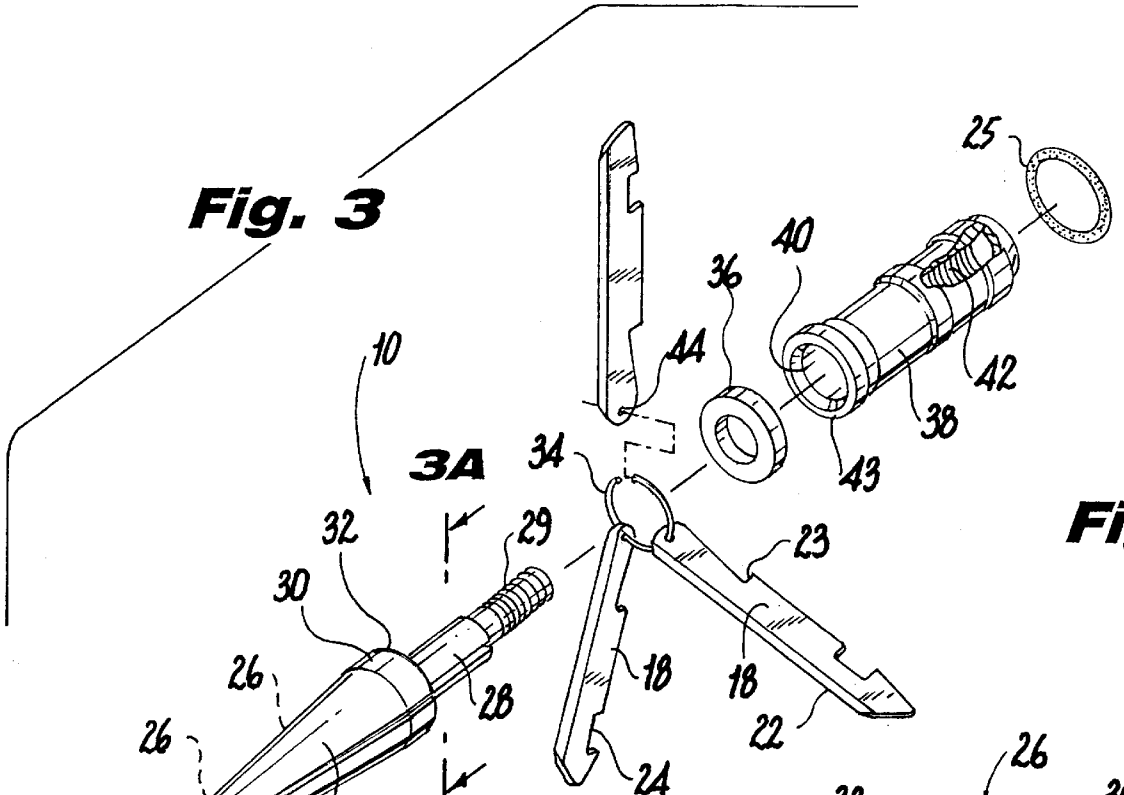
FIG. 3 illustrates an exploded view of the broadhead of the present invention showing its novel means for securing the cutting blades to the broadhead.
Figure 3A:
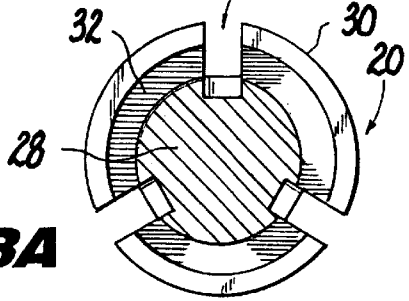
FIG. 3*a* is a cross section of the broadhead of the present invention taken along line 3*a*—3*a* of FIG. 3.

FIG. 3 shows the assembly of the cutting blades 18 to broadhead 10, and FIG. 4 shows a cross-section of the fully assembled broadhead 10. As seen in FIG. 3, pointed tip 16 is frictionally fit, threaded or press fit in a conventional manner onto ferrule 20 of broadhead 10. A post member 28 having a smaller diameter than the outer diameter of outer diameter of ferrule 20 extends proximally from the ferrule 20 at an end opposite the pointed tip 16. The post member 28 includes a threaded portion 29 for facilitating connection of the broadhead 10 to the shaft 12 as further described below. A circular wall 30 also extends from the end opposite the pointed tip 16, specifically from the outer peripheral surface of the ferrule 20. A circular gap 32 is thus formed between the circular wall 30 and the post member 28, as illustrated in FIG. 3*a*.

The securement mechanism for securing the cutting blades 18 to the broadhead 10 comprises a ring 34 for holding the cutting blades 18 as a single replaceable unit, a washer 36, and a cylindrical insert 38, which is insertable into the end of the arrow shaft 12 as shown in FIG. 1. The insert 38 includes a central bore 40 having an internal threaded portion 42. Each cutting blade 18 includes a hole 44 at one end for coupling with ring 34.

To secure the expanding cutting blades 18 to the broadhead 10, the ring-cutting blade assembly is first placed over the post member 28 and the cutting blades 18 are aligned with the slots 26. The alignment of the cutting blades 18 within the slots 26 also aligns the cutting blades 18 with the longitudinal axis of the broadhead 10, since the slots 26 are properly aligned with the longitudinal axis of the ferrule 20 during the manufacture of the broadhead 10. This obviates the requirement for exact precision measurements present in the assembly of prior art broadheads while providing a precise alignment of the cutting blades 18 with the longitudinal axis of the broadhead 10, which ensures that the assembled broadhead 10 will be properly balanced for accuracy in flight.

After the ring-cutting blade assembly is placed over the post member 28, the washer 36 is then placed over the post member 28. The washer 36 is typically constructed of a hardened steel or similar material, to facilitate the forcing of the ring-blade assembly into position on the ferrule 20 as will be described below. The ferrule, blade and washer assembly is then joined to an arrow, as in FIGS. 1 and 4, having the cylindrical insert 38 in place on the distal end of the arrow shaft 12. While the cutting blades 18 are held within their respective slots 26, the insert 38 and arrow shaft 12 are rotated so that the threaded portion 29 of the post member 28 engages the internal threaded portion 42 of the cylindrical insert 38.

As the insert 38 and arrow shaft 12 are rotated onto post member 28, the distal end 43 of insert 38 engages the washer 36 facing the insert 38, forcing the washer 36 to move distally towards the ferrule 20. As the cylindrical insert 38 and arrow shaft are further rotated, the washer 36 contacts the proximal ends of the cutting blades 18 near the area where the ring 34 is attached to each cutting blade 18. The washer 36 applies pressure to the cutting blades 18 forcing the ring 34 to compress slightly and become wedged in the circular gap 32 formed between the post member 28 and the circular wall 30 extending from the ferrule 20, thereby firmly securing the ring-cutting blade assembly to the broadhead 10. While the washer 36 facilitates the forcing of the ring 34 into gap 32, it may be eliminated, whereby the distal end 43 of insert 38 may be utilized to force the ring distally. In this case, the material of which the insert 38 is constructed may be steel or a material of like hardness.

The elastic o-ring 25 is provided and held in place by the notch 23 on each cutting blade 18 for partially maintaining the cutting blades 18 within the slots 26 while the cutting blades 18 are in an undeployed retracted position. The elastic o-ring 25 disengages the notches 23 when the arrow 14 strikes a target 48, as seen in FIGS. 5 and 6, for enabling the cutting blades 18 to move into a deployed expanded position as explained below.

It is also contemplated that the cylindrical insert 38 may be provided without a threaded portion 42 and be constructed of a material that is self-tapping, such as aluminum. Rotation of the aluminum insert 38 over the post member 28 allows the threaded portion 29 of the post member 28 to create internal threads on the inner surface of cylindrical insert 38. In addition, it is further contemplated that threads be eliminated in both the post member 28 and the shaft 38, so that post member 28 is forced into the central bore 40, and is held in place through the use of, for example, a raised detent.

When the arrow 14 strikes a target 48, the pointed tip 16 of the broadhead 10 pierces the target 48 as illustrated in FIG. 5. As the arrow 14 continues to penetrate the target 48, the area immediately surrounding the point of entry makes contact with the portion of the cutting blades 18 partially extending from the slots 26. The force applied by the target 48 on the cutting blades 18 causes the blades 18 to move in a direction opposite the target 48. This motion causes the elastic ring 25 to be forced rearwardly and disengage the notches 23, to enable the cutting blades 18 to move into a deployed expanded position as illustrated in FIG. 6. The path of travel of blades 18 is limited by washer 36 (or by the end of insert 38 when the washer 36 is not used). The expanded cutting blades 18 thus cut and enter the target 48 causing the area of impact to be enlarged.

The blades 18 can be prevented from deploying by being tied to the broadhead 10 as illustrated in FIG. 10. Specifically, a string or wire 46, or the like, is used to tie the blades 18 to the broadhead 10 by winding the string 46 around the distal notch 24 on each cutting blade. In this configuration the cutting blades 18 will be held in the undeployed position when the broadhead 10 strikes the target 48, such that the broadhead 10 may be utilized as a target point.

FIGS. 7–9 illustrate a method for removing the cutting blades 18 from the broadhead 10 of the present invention. For simplicity, the arrow shaft has been eliminated from the drawings. First, as shown in FIG. 7, the broadhead 10 is partially removed from insert 38 by being partially unthreaded from the post member 28. The elastic ring 25 is disengaged from the notches 23 enabling the cutting blades 18 to swing towards the insert 38. As shown in FIG. 8, the ferrule 20 of the broadhead 10 is placed against a block 50, preferably having a cylindrical bore 52, although any surface having a bore will suffice. The bore 52 preferably is narrower than the cross section of the cutting-blade assembly, thus preventing the cutting blades 18 from entering the bore 52. The end of the arrow shaft, or insert 38, is then placed over a hard, durable surface 54, as illustrated in FIG. 9. The block 50 is pushed toward the surface 54 causing pressure to be applied to each cutting blade 18 at a point near where the ring 34 is connected to each cutting blade 18. This action also causes pressure to be applied to the ring 34 in a direction opposite the pointed tip 16. The pressure unwedges the ring 34 from the circular gap 32. The insert 38 is then fully unthreaded and the broadhead 10 is removed, which enables the removal of the ring-cutting blade assembly. A new set of cutting blades with their associated ring can then be placed over the post member 28 and secured to the broadhead 10 as a single replaceable unit as described above. Alternatively, the ferrule 20 may be placed on a surface having a bore, and the arrow shaft may be used to push downwardly on the broadhead 10 whereby the blades 18 are forced proximal to the tip 16 for removal.

While the invention has been particularly shown and described with reference to the preferred embodiment, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. A broadhead for an arrow or the like comprising:

a body portion having a circular cross-section and defining a proximal end and a distal end, a post member extending from the proximal end having an outer diameter less than an outer diameter of the body portion, and an outer peripheral surface protruding from the proximal end concentrically about said post member thereby defining a circular gap between said outer peripheral surface and said post member; a pointed tip at the distal end of said body portion opposite said post member; and a replaceable cutting blade assembly having at least one cutting blade movable from a retracted position to an expanded position, and a compressible ring for holding said at least one cutting blade, said compressible ring having a first uncompressed diameter larger than an outer diameter of said circular gap, said compressible ring being insertable within said circular gap to define a second compressed diameter to secure said cutting blade assembly to said body portion.

2. A broadhead as in claim 1, wherein an insert is placed within an arrow shaft at one end of said arrow, said insert and said post member include threaded portions for threadedly engaging said threaded portion of said insert to said threaded portion of said post member for securing said broadhead to said arrow.

3. A broadhead as in claim 2, further comprising a washer placed between said compressible ring and an insert placed over said post member, said washer forcing said compressible ring to become wedged in said circular gap as said insert is moved against said compressible ring.

4. A broadhead as in claim 1, wherein an insert is placed within an arrow shaft at one end of said arrow, said insert is frictionally fit to said post member for securing said broadhead to said arrow.

5. A broadhead as in claim 1, wherein said body portion includes at least one slot extending from each opposed end of said body portion for partially accepting a cutting blade of said cutting blade assembly when said cutting blade is in said retracted position.

6. A broadhead as in claim 1, wherein said at least one cutting blade includes a retaining notch on a side opposite a cutting edge for holding a retaining means, the notch and retaining means cooperating to maintain said at least one cutting blade in said retracted position.

7. A broadhead as in claim 6, wherein said retaining means is an elastic ring.

8. A broadhead as in claim 6, wherein said retaining means is a string.

9. A broadhead as in claim 6, wherein said at least one cutting blade is movable to said expanded position when said retaining means is removed from said retaining notch.

10. A method for replacing a cutting blade assembly of a broadhead, the blade assembly having at least one cutting blade movable from a retracted position to an expanded position, and the broadhead having a body portion with a circular wall and a post member extending from a proximal end to form a circular gap between said circular wall and said post member, and where said cutting blades are held together at their respective proximal ends by a ring to form a ring-cutting blade assembly, said method for replacing the cutting blade assembly comprising the following steps:

a. inserting said ring-cutting blade assembly over said post member;

b. inserting a washer over said post member;

c. inserting an insert over said post member; and d. moving said insert toward said ring-cutting blade assembly to force said washer against said ring cutting-blade assembly to compress and wedge said ring within said circular gap to secure said ring-cutting blade assembly to said broadhead.

11. A broadhead for an arrow or the like comprising:

a body member;

a pointed tip of a distal end of said body member; and a cutting blade assembly removably secured to the body member, the blade assembly having a plurality of blades joined to each other by a ring member, said ring member being insertable into a portion of the body member to secure the blade assembly to the member, said ring member being compressible to fit into the portion of the body member to secure the blade assembly to the body member.

12. A broadhead according to claim 11, wherein the body member includes a post member at an end opposite the pointed tip, said post member having a diameter less than the outer diameter of the body member, and extending from a bore defined by an outer surface of the body member, said ring member being compressible into the bore to secure the blade assembly to the body member.

13. A broadhead according to claim 12, wherein the body member includes a plurality of longitudinally directed slots corresponding in number to said plurality of blades, such that at least a portion of a blade fits into each slot when ring member is disposed in the bore.

14. A broadhead according to claim 13, wherein said blades are pivotable from a forwardly directed, non-deployed position, to a rearwardly directed, deployed position upon impact with a target, at least a portion of a blade being disposed in a corresponding slot when the blade is in the non-deployed position.

15. A broadhead according to claim 14, further comprising means for retaining the broadhead in the non-deployed position, said retaining means being disengagable upon impact to permit pivoting of said blades to the deployed position.

16. A broadhead according to claim 15, wherein the retaining means is an elastic ring.

17. A broadhead according to claim 13, further comprising a locking washer for positioning over the post member to urge said ring member and blades toward said bore when the post member is placed on the edge of an arrow shaft.

18. A broadhead according to claim 14, further comprising means for retaining the broadhead in the non-deployed position, said retaining means preventing pivoting of said blades to the deployed position upon impact.

* * * * *